United States Patent [19]

Walker et al.

[11] Patent Number: 4,838,069

[45] Date of Patent: Jun. 13, 1989

[54] APPARATUS FOR FABRICATING INTEGRALLY BLADED ROTORS

[75] Inventors: Rayond M. Walker, Lucie; Donald G. MacNitt, Singer Island, both of Fla.

[73] Assignee: United Technologies Corporation, Hartford, Conn.

[21] Appl. No.: 155,323

[22] Filed: Feb. 12, 1988

[51] Int. Cl.[4] ..... B21K 3/04

[52] U.S. Cl. ..... 72/342; 72/407; 72/420; 29/156.8 B

[58] Field of Search ..... 72/342, 364, 407, 361, 72/420; 29/156.8 B

[56] References Cited

U.S. PATENT DOCUMENTS

| | | | |
|---|---|---|---|
| 1,291,658 | 1/1919 | Roth | 72/342 |
| 2,724,420 | 11/1955 | Clark, Sr. et al. | 72/342 |
| 3,375,694 | 4/1968 | Pratt | 72/364 |
| 3,519,503 | 7/1970 | Moore et al. | 148/11.5 |
| 3,643,327 | 2/1972 | Jackson | 72/407 |
| 3,741,821 | 6/1973 | Athey et al. | 148/13.1 |
| 4,150,557 | 4/1979 | Walker et al. | 72/354 |
| 4,252,011 | 2/1981 | MacNitt, Jr. et al. | 72/354 |
| 4,265,105 | 5/1981 | MacNitt, Jr. et al. | 72/354 |
| 4,312,211 | 1/1982 | MacNitt, Jr. et al. | 72/354 |
| 4,474,044 | 10/1984 | Leistner et al. | 72/342 |
| 4,527,410 | 7/1985 | MacNitt, Jr. et al. | 72/306 |
| 4,530,229 | 7/1985 | Walker | 72/354 |
| 4,531,396 | 7/1985 | MacNitt, Jr. et al. | 72/354 |
| 4,663,011 | 5/1987 | Hinman | 204/224 M |

FOREIGN PATENT DOCUMENTS

| | | | |
|---|---|---|---|
| 174246 | 10/1984 | Japan | 29/156.8 B |
| 1228938 | 5/1986 | U.S.S.R. | 29/156.8 B |

*Primary Examiner*—Lowell A. Larson

*Attorney, Agent, or Firm*—James M. Rashid

[57] ABSTRACT

A method and apparatus are disclosed which are useful for fabricating integrally bladed rotors. In particular, the method and apparatus are used to increase the twist of the blades on the rotor from a first degree of twist to a second degree of twist under superplastic forming conditions. The apparatus is constructed and arranged such that the method can be carried out at ambient atmospheric conditions. A key feature of the invention is that the blade twisting dies are present in the blade heating zone only when the dies contact the blade. When the dies are not in contact with the blades, they are at ambient conditions where oxidation is at a minimum.

16 Claims, 3 Drawing Sheets

APPARATUS FOR FABRICATING INTEGRALLY BLADED ROTORS

This invention was made with United States Government support under a contract awarded by the Department of the Air Force. The Government has certain rights in this invention.

TECHNICAL FIELD

This invention relates to fabricating integrally bladed rotors, and more particularly to methods and apparatus for twisting the blades of an integrally bladed rotor.

BACKGROUND ART

In most modern gas turbine engines, the compressor and turbine sections each includes at least one stage of blades which are mechanically attached to the rim of a disk which rotates at high speeds. However, engine designs which incorporate mechanical blade attachment schemes suffer from several inefficiencies. Most notably, during engine operation, air leaks through the attachment area, and such air is therefore not available to provide compressive thrust to the engine. Furthermore, mechanical blade attachments configurations add additional weight to the disk, which is undesirable. In order to meet the goals of increased engine performance and reduced weight in advanced engine designs, new concepts for designing rotating engine components must be exploited. One solution which has been proposed is to use integrally bladed rotors, where the blades are integral with the disk rim. The elimination of mechanical blade attachments significantly reduces engine weight by reducing the size of the disk and its cascading effect on shaft size, bearing size, etc. Air leakage around blades is also eliminated, thereby increasing engine operating efficiency. Techniques for forming such types of rotors are described in, for example, commonly assigned U.S. Pat. Nos. 4,150,557 to Walker et al and 4,527,410 to MacNitt, Jr. et al, both incorporated by reference. The fabrication of integrally bladed rotors from superalloys such as IN100 requires that the forging process take place under superplastic conditions. One superplastic forging technique which has found widespread use in the industry is the Gatorizing® forging method (United Technologies Corporation, Hartford, CT), which is generally described in commonly assigned U.S. Pat. No. 3,519,503 to Moore and Athey, also incorporated by reference.

Superplastic forming is generally conducted at isothermal conditions; before the forming dies contact the component to be formed, the dies are preheated to a temperature which approximates the temperature to which the component is heated. When the dies and component are both at the desired temperature, the dies are brought into contact with the component and the forming operation takes place. Since the dies are made from materials which have excellent high temperature strength but poor high temperature oxidation resistance, an inert atmosphere is required to minimize (or prevent, if possible) oxidation or other thermal degradation of the dies. The atmosphere is contained within a sealed chamber, and the chamber completely surrounds the forming apparatus and the component.

The integrally bladed rotor technology developed to date has proven useful for fabricating rotors having a relatively small diameter, i.e., less than about 38 cm (about 15 in.). For the gas turbine engine industry to take full advantage of the benefits of integrally bladed rotors, the technology must be scaled up to the point where fabrication of rotors greater than about 45 cm (about 18 in.) in diameter can be made. The use of the prior art techniques does not appear to be economically efficient for making such large diameter rotors, since increases in rotor diameter requires larger and more complicated forming apparatus. Also, the inert atmosphere chambers for housing the forming apparatus become more complicated. Accordingly, what is needed is a method and apparatus for superplastically forming integrally bladed rotors in a more simple fashion.

The aforementioned patent to MacNitt, Jr. et al discloses that the manufacture of some integrally bladed rotors requires the use of multiple superplastic forming operations and dedicated apparatus for each operation. In particular, some rotor blades require multiple twisting operations to achieve the desired blade camber. Such multiple twist operations are costly, particularly in view of the capital equipment expenditure required to operate and maintain the specialized equipment. These problems also point to the need for more simple methods and apparatus for forming integrally bladed rotors.

SUMMARY OF THE INVENTION

This invention is a method and apparatus for forming the blades on an integrally bladed rotor. In particular, the invention relates to twisting the blades of an integrally bladed rotor from a first degree of twist to a second degree of twist under superplastic forming conditions. The method and apparatus are designed so that the forming operation is conducted in open air conditions; i.e., the process need not be conducted under an inert or protective gas atmosphere, as has been required when prior art techniques are used.

Generally speaking, the invention apparatus is constructed and arranged so that the blade to be formed is locally heated within a heating zone to the desired superplastic forming temperature. While the blade is being heated, the blade forming dies are outside of the heating zone and maintained at substantially ambient conditions. As a result, oxidation of the dies is minimized. Once the blade reaches the desired forming temperature, the dies are moved into the heating zone and into contact with the heated blade, and the blade is twisted to the desired geometry. The dies are then moved out of contact with the blade and out of the heating zone, and the rotor indexed to move another blade into position to be formed. Once that other blade reaches the desired forming temperature, the dies move back into the heating zone and into contact with it. The process continues until the required number of blades have been twisted to the desired geometry.

In the preferred embodiment of the invention, the rotor is fixedly secured to a support structure which is itself positioned between a pair of blade heaters. The heaters are constructed to radiantly heat several circumferentially adjacent blades at the same time. Each heater has a passageway through which one of the blade forming dies moves between a first die position (within the heating zone) and a second die position (outside of the heating zone). The dies have passages through which cooling fluid circulates to control their temperature during the forming process. The time that the dies are in the heating zone is short, so that an inert atmosphere to protect the dies from oxidation is not needed. As a result, no chamber to retain such an atmosphere is necessary, and the apparatus for superplastically changing the degree of blade twist is much more simple than the apparatus of the prior art.

Other features and advantages of the invention will be apparent from the drawings and description of the best mode for carrying out the invention, which follow.

BEST MODE FOR CARRYING OUT THE INVENTION

This invention is described in terms of the fabrication of an integrally bladed rotor, and in particular, in terms of an apparatus and method for the superplastic forming of blades which extend from the rim of the rotor, to change the degree of blade twist. However, it will be apparent from the following description that the invention is also useful in hot working other disk-shaped components which have appendages which extend radially outwardly from the component rim.

Figure 1:
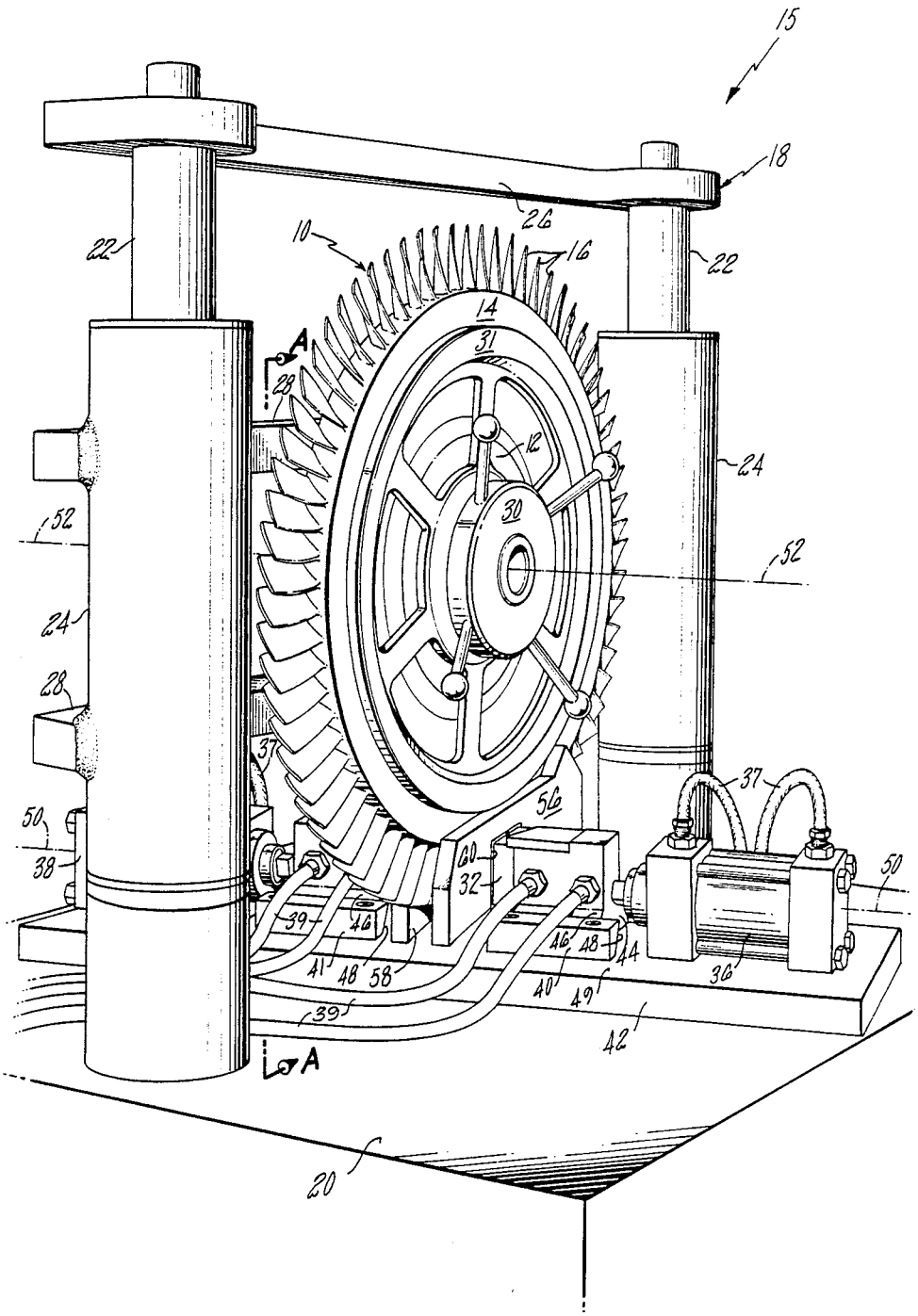
FIG. 1 is a simplified view, partly in perspective, showing the apparatus of this invention.

Referring to FIG. 1, an integrally bladed rotor 10 is shown as comprising a central hub section 12, a rim 14 at the outer periphery of the hub 12, and blades 16 which are spaced apart from each other about the circumference of the rim 14 and extend radially outwardly from the rim 14. The blades 16 are integral with the rim 14, either because the central portion of the rotor 10 and the blades 16 were forged from the same starting stock of material, or because the blades 16 were bonded to the rim 14 in a separate fabrication step. The rotor 10 includes a bore 11 through which the rotor axis 52 extends.

With respect to the following description of this invention, the blades 16 of the rotor 10 have a first degree of twist, fabricated, for example, according to the technique described in the above-mentioned patent to Walker et al. Use of the present invention imparts a second degree of twist to the blades 16.

The blade twisting apparatus 15 includes a rotor support structure 18 (see FIG. 2) which is secured to a horizontal support table 20. The support structure 18 includes a pair of vertical posts 22 which are fixedly secured to each other by the crossbar 26 and to the table 20. The posts 22 pass through cylinders 24, and the cylinders 24 are slidable on the posts 22. Attached to the crossbars 28 is a bearing carrying support plate 29 which cooperates with attachment fixture 30 and retaining ring 31 for fixedly securing the rotor 10 in the vertical plane to the crossbars 28 and therefore to the support structure 18. See FIG. 3A. In particular, a spindle 33 rotates on bearings carried by the plate 29; the spindle 33 has an outside diameter which approximates the inside diameter of the rotor bore 11, and passes through the bore 11 when the rotor 10 is secured to the support structure 18. The attachment fixture 30 is threaded onto the end of the spindle 33, over the retaining ring 31.

Figure 3A:
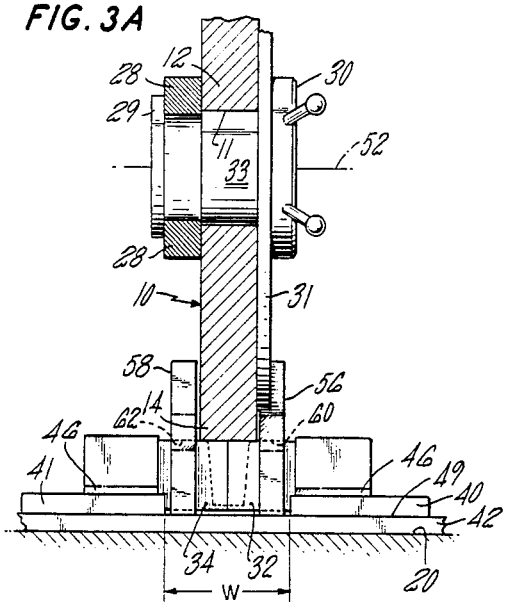
FIGS. 3A and 3B and 4A and 4B are simplified cross-sectional views of the dies and heaters used in the invention, shown generally along the lines A—A of FIG. 1.
Figure 3B:
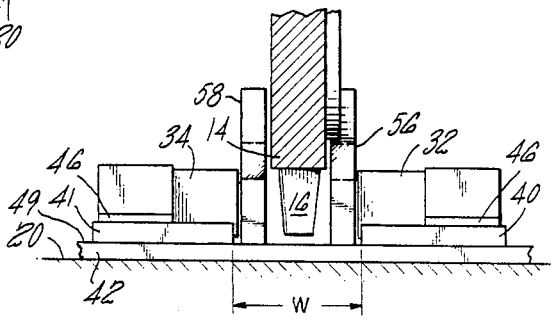

Referring also to FIGS. 3A and 3B, the blade twisting apparatus 15 includes dies 32, 34 which move between a first die position (shown in FIG. 3A) to twist the blade 16 to the desired degree of twist and a second die position (shown in FIG. 3B). The dies 32, 34 have contact surfaces which cooperate to form a cavity having a shape corresponding to a blade having the desired degree of twist. One of the dies has a surface for contacting the suction (concave) side of the blade 16, and the other die has a surface for contacting the pressure (convex) side of the blade 16. Each die 32, 34 is moved between the first and second die positions and along a die axis 50 which is related to the particular blade geometry. The dies 32, 34 are moved by hydraulic actuators 36, 38; hoses 37 carry hydraulic fluid from a source (not shown) to the actuators 36, 38. Hoses 39 carry coolant fluid from a source (not shown) to the dies 32, 34; the fluid moves through passages within the dies 32, 34 to maintain the dies at a relatively low temperature during the twisting operation. Also, the cool dies act as a buffer to isolate the actuators 36, 38 from the heat produced during the twisting operation.

The path of die movement is governed by the wedge shaped die guides 40, 41. The guides 40, 41 rest upon guide support 42 which is secured to the table 20. Each die 32, 34 has a trapezoidal shaped root section 44, and the root surfaces 46 slidingly mate with the wedge shaped surfaces 48 of the guides 40, 41 and with the surface 49 of the guide support 42.

As best shown in FIGS. 3A and 3B, the rotor 10 is fixedly secured to the support structure 18, and between the dies 32, 34 and their respective die guides 40, 41. To allow the rotor 10 to rotate about its axis 52 (discussed in more detail below), the guides 40, 41 are axially separated from each other by a distance W at least equal to the width of the blade 16.

This invention is particularly useful in the superplastic forming of blades of an integrally bladed rotor. In order to accomplish such forming, the blade 16 to be twisted must be heated to a temperature within the rotor alloy superplastic temperature range. The term "superplastic forming temperature range" is the temperature within which the rotor becomes superplastic, but below the temperature at which significant grain growth occurs. While this temperature range depends on the particular alloy from which the rotor is fabricated, for an alloy such as IN100, the superplastic forming temperature range is between about 985° C. and 1,095° C. (between about 1,800° F. and 2,000° F.). Of course, the rotor must have the required fine grained microstructure necessary for superplastic forming. See, for example, the aforementioned patent to Moore and Athey. For IN100, a grain size within the range of ASTM 12.5-13.5 (about 4.7–3.3 microns) is preferred. As shown in the FIGS., the forming apparatus 15 includes heaters 56, 58 which are constructed and arranged for raising the temperature of at least one blade 16 to a temperature within the alloy superplastic forming temperature range, and to raise the temperature of the portion of the rim 14 from which the blade 16 extends to a temperature approximately equal to the blade temperature. It is necessary to heat both the blade 16 and the rim 14 to prevent the rim 14 from acting as a heat sink during the forming operation; heating the hub portion 12 of the rotor 10 does not seem to be necessary.

Preferably, the heaters 56, 58 are disposed directly adjacent to the rotor 10, and are as close to the blade to be twisted as possible. In such a construction, the heaters 56, 58 produce a local and well-defined heating zone which surrounds the blade 16. Most preferably, and as shown in FIG. 1, the heaters 56, 58 surround a circumferential sector of the rotor 10 so as to simultaneously heat several adjacent blades. When the apparatus is used to twist each blade of the rotor, this heater configuration greatly reduces the overall time necessary to heat the blades to within their superplastic forming temperature range. The temperature of the rotor blade 16 being twisted is monitored by conventional techniques, such as by using thermocouples, thermographic paint, or optical pyrometers.

A passageway 60, 62 extends along the die axis 50 through each heater 56, 58, respectively, and is sized to allow each blade forming die 32, 34 to move through its heater, in and out of the heating zone, between the first and second die positions. The passageways 60, 62 are large enough to permit the dies 32, 34 to move along the die axis 50, but are also as small as is practical, to limit the escape of heat from the heating zone. During operation of the blade twisting apparatus 15, the dies 32, 34 are kept within the heating zone no longer than the time necessary to twist the blade 16 to the second degree of twist. Owing to the superplastic condition of the rotor blade 16, the time necessary to twist the blade is short. During the twisting operation, the dies are heated, but not to a temperature sufficient to do damage to the dies due to the coolant which passes through them. At the conclusion of the twisting operation, the hydraulic units 36, 38 remove the dies 32, 34 from the heating zone, and place them in the second die position where they rest at ambient conditions. As a result of the movement of the dies 32, 34 between the first and second die positions, and the minimal input of heat to the dies during the twisting operation, a protective gas atmosphere to protect the dies from oxidation is not necessary.

The blade forming apparatus 15 includes means (not shown) for automatically rotating the rotor 10 about its axis 52 at the completion of each blade twisting operation, and while the dies 32, 34 are in the second die position. In other words, after a blade "N" in circumferential position "n" is twisted, the rotor is indexed to bring blade "N+1" into position "n+1" and into alignment with the dies 32, 34. Preferably, blade "N+1" is circumferentially adjacent to blade "N", to take advantage of the blade preheating described above. At the completion of each blade twisting operation, the rotor 10 is again rotated until each blade 16 has been twisted, or until the required blades have been twisted.

Figure 4A:
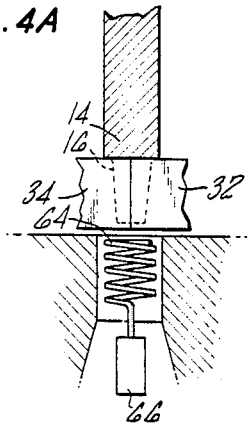
Figure 4B:
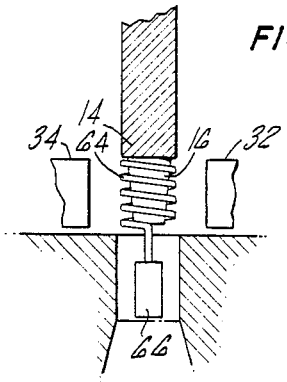

FIG. 1 shows the preferred construction for the heaters 56, 58 which radiantly heat the blade 16 in a heating zone: The heaters 56, 58 are axially spaced apart and the passages 60, 62 allow for the axial movement of the blade forming dies 32, 34 between the first and second die positions. In an alternate embodiment of this invention shown in FIGS. 4A and 4B, the blade 16 is heated by an induction coil 64, similar to the manner described by Athey and Moore in commonly assigned U.S. Pat. No. 3,741,821, which is incorporated by reference. The coil moves between a first coil position (FIG. 4A) and a second coil position (FIG. 4B). In the second coil position, the coil 64 surrounds the blade 16 and creates a heating zone which raises the temperature of the blade 16 to within the superplastic forming temperature range, while the blade forming dies 32, 34 are in the second die position. Once the desired forming temperature has been reached, the coil 64 is moved radially outwardly by the coil moving apparatus 66 to the first coil position, and the blade forming dies 32, 34 move to the first die position to contact and twist the heated blade 16. After the blade 16 has been twisted, dies 32, 34 are automatically moved back to the second die position, the rotor 10 is indexed to its next position, and the coil 64 is moved back into the second coil position to heat the next blade. The process continues along the liner discussed above.

After all of the rotor blades 16 have been twisted, the support apparatus 18 (and the rotor attached thereto) is moved vertically upward, sliding on the posts 22. Such movement removes the rotor 10 from the vicinity of the heaters 56, 58, and the rotor 10 can then be easily removed from the structure 18.

While FIG. 1 shows the blade forming apparatus 15 as comprising only one pair of blade forming dies 32, 34 and one pair of radiant heaters 56, 58, the apparatus 15 may include several pairs of dies and heaters so that more than one blade 16 would be formed at any one time. In this regard, the invention contemplates several heating and forming stations disposed approximately circumferentially about the rotor 10. Such stations would each be characterized by the features discussed above, and in particular, by means for moving the forming dies into and out of contact with a heated blade such that the dies are not continuously in the heating zone.

This invention can also be used for repair and manufacturing-type forming operations. For example, if one or more of the rotor blades becomes damaged, or inspection reveals that one or more blades is not within the required twist tolerances, the invention can be used to retwist such blade or blades.

The invention apparatus and method was used in the fabrication of an integrally bladed rotor made of the superalloy designated IN100. IN100 is a widely used nickel base superalloy having a composition, by weight percent, of 8-11Cr, 13-17Co, 2-4Mo, 4.5-5Ti, 5-6Al, 10-11Al+Ti, 0.15-0.20C, 0.01-0.02B, 0.7-1.2V, 0.03-0.09 Zr, balance Ni and incidental impurities. In the first step of the overall rotor fabrication process, superplastic forming techniques similar to those described in commonly assigned U.S. Pat. No. 4,150,557 to Walker et al were used to form a powder metallurgy preform to a near net shape rotor having a diameter of about 61 cm (24 in.). The rotor had 70 blades which were about 6.4 cm (2.5 in.) in length. The distance from the blade leading edge to the blade trailing edge was about 3.8 cm (1.5 in.) and the maximum thickness of each blade was about 0.8 cm (0.3 in.). Microstructural evaluation of the rotor after the initial forming operation revealed that it had a fine grain size of about ASTM 12-13.5 (about 3.3-5.6 microns). To accommodate differences between the coefficient of thermal expansion between the forming dies and the rotor blades, and to account for tooling tolerances, an envelope of between 0.1 and 0.2 cm (between about 0.04 and 0.08 in.) was present around each blade. The envelope was greater near the root portion of the blade; the envelope was removed (as described below) after the twisting operation.

Figure 2:
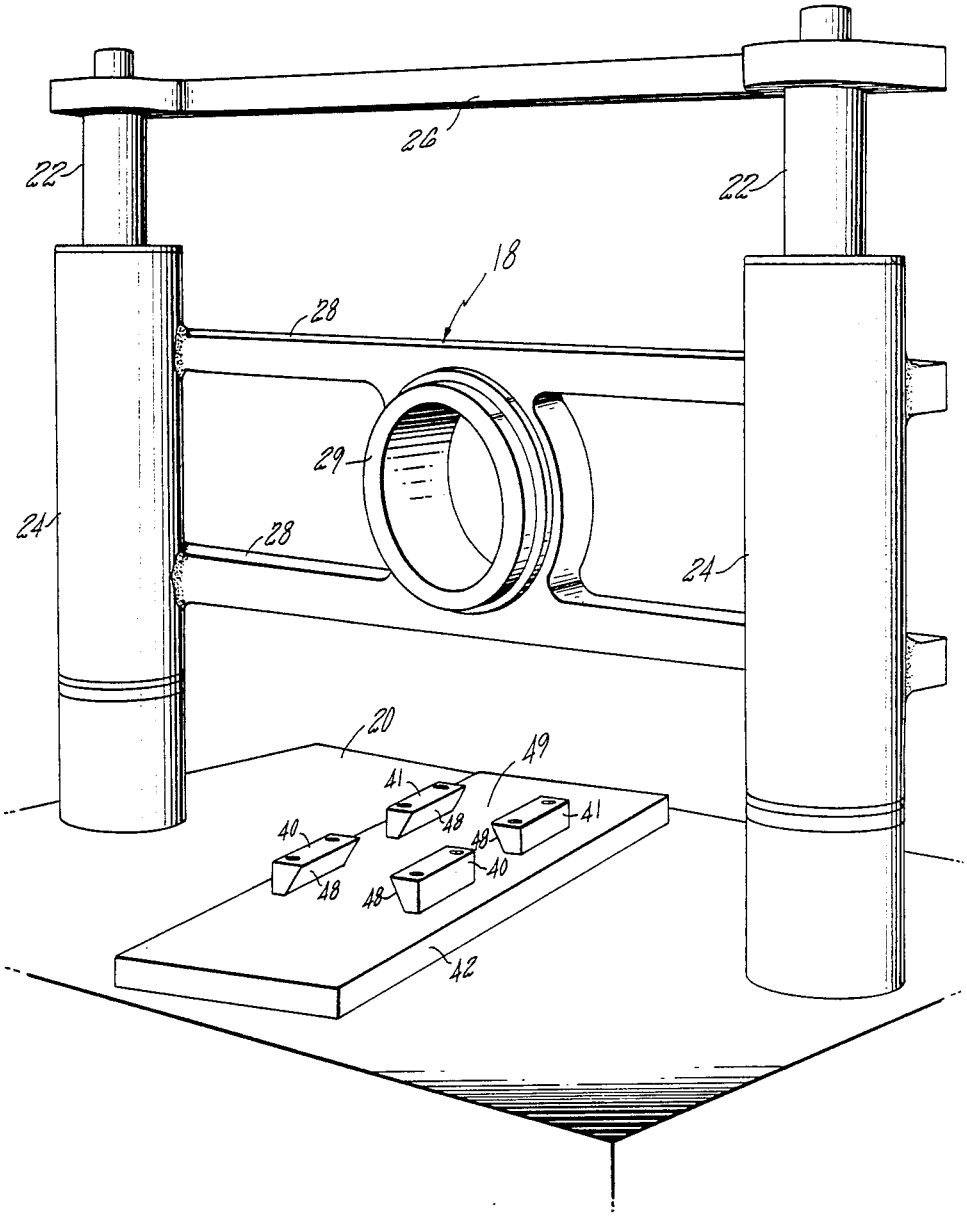
FIG. 2 is a view showing the blade forming die guides.

The rotor was assembled into an apparatus substantially corresponding with that shown in FIGS. 1 and 2, where the blades were radiantly heated and then contacted by TZM molybdenum dies coated with a thin layer of boron nitride. The blades were sequentially heated to a forming temperature of about 1,040° C. (1,900° F.), which is within the preferred superplastic forming temperature range for INlOO. After each blade reached its desired forming temperature, the blade forming dies were moved from outside the heating zone to a position where they contacted and twisted the heated blade. The blades were twisted about 26° about their stacking line, at a rate sufficient to accomplish approximately three to five degrees of twist per second. After the blade had been twisted to the desired degree of twist, the dies were moved out of the heating zone. The rotor was indexed into position to twist the circumferentially adjacent blade, and the process repeated. The movement of the dies and rotation of the rotor was coordinated by conventional software. After twisting several blades in this fashion, the rotor was inspected. No cracks were located in the formed blades, and the blades had the desired degree of twist.

The rotor was then heat treated to optimize the superalloy properties. The heat treatment cycle was conducted under inert gas atmosphere conditions, and was as follows: Heat to about 1,100° C.±8° C. (about 2,065° F. ±15° F.) for 120–140 minutes and oil quench; then heat to about 870° C.±8° C. (1,600° F.±15° F.) for 35–45 minutes and cool to below about 370° C. (700° F.) at a rate equivalent to air cool; then heat to about 980° C.±8° C. (1,800° F.±15° F.) for 40–55 minutes and cool to below 370° C. (700° F.) at a rate equivalent to air cool; then heat to about 650° C. ±8° C. (1,200° F.±15° F.) for 24 hours and cool to below 370° C. (700° F.); then heat to about 760° C.±8° C. (1,400° F.±15° F.) for 4 hours and air cool to below 370° C. (700° F.).

The rotor was then ultrasonically inspected using conventional techniques, which revealed no internal defects. After inspection, the blades were electrochemically machined to their final dimensions, to remove the envelope which was present prior to the twisting operation. Machining techniques such as those disclosed in U.S. Pat. No. 4,663,011 to Hinman were used. Following a final machining operation of other details on the rotor, and another inspection, the rotor was ready for installation and use in a gas turbine engine.

This invention is useful in the superplastic forming of other alloys besides besides IN100, for example, the nickel based alloys commonly known as modified IN100, IN 718, Waspaloy, Astroloy, Udimet 500, Rene 95, Inconel X, Inconel 625 and AF2-lDA. Components made of titanium base alloys such as Ti-8-1-1, Ti-6-2-4-6 and Ti-6-4 can also be fabricated using the methods and apparatus of this invention. Integrally bladed rotors are not the only components which can be made according to this invention; other components will be apparent to those skilled in the art.

Although this invention has been shown and described with respect to detailed embodiments thereof, it will be understood by those skilled in the art that various changes in form and detail may be made without departing from the spirit and scope of the claimed invention. For example, while the invention is particularly adapted for superplastic forming, it can also be used for more conventional hot forming operations.

We claim:

1. Apparatus for superplastic forming an integrally bladed rotor to twist a rotor blade from a first degree of twist to a second degree of twist, the rotor comprising a disk having an axis, a rim, and a plurality of circumferentially spaced apart blades extending radially outwardly from the rim and integral therewith, the apparatus comprising:

(a) first and second blade forming die means movable along a common axis, said die means having surfaces for contacting substantially the entire blade surface, wherein said die surfaces cooperate to form a blade cavity, and said blade cavity substantially corresponds to a blade having said second degree of twist;

(b) means for securing the rotor in a fixed position between said first and second die means such that one of the rotor blades is aligned with the die axis;

(c) means for providing a heating zone for raising the temperature of the blade aligned with the die axis to a temperature sufficient to render the blade superplastic; and (d) means for moving each of said die means along the die axis and between first and second die positions, such that in said first die position said contact surfaces are in twisting contact relation with substantially the entire blade surface in said heating zone, and in said second die position said contact surfaces are in noncontacting relation with the blade in said heating zone and said die means are out of said heating zone.

2. The apparatus of claim 1, wherein said heating means comprises means for inductively heating the blade aligned with said die axis.

3. The apparatus of claim 2, wherein said induction heating means includes an induction coil constructed and arranged for surrounding the blade aligned with said die axis.

4. The apparatus of claim 3, wherein said induction heating means includes means for moving said coil between a first coil position and a second coil position, such that in the second coil position said coil surrounds the blade aligned with said die axis, and in said first coil position said coil is radially outward of the blade aligned with said die axis.

5. The apparatus of claim 4, wherein said apparatus includes means for automatically moving said coil from said first coil position to said second coil position while said blade forming dies are moving from said first die position to said second die position.

6. The apparatus of claim 1, wherein said heating means comprises means for radiantly heating the blade aligned with said die means.

7. The apparatus of claim 6, wherein said radiant heating means is constructed and arranged such that the blade aligned with said die axis and the rim of the disk from which said blade extends is within the heating zone, and the portion of the rotor radially inwardly of the rim is outside of the heating zone.

8. The apparatus of claim 7, wherein said radiant heating means is constructed and arranged such that only the blade to be twisted of the plurality of rotor blades is in said heating zone.

9. The apparatus of claim 7, wherein said radiant heating means is constructed and arranged such that a plurality of circumferentially adjacent blades of the rotor are simultaneously in said heating zone.

10. The apparatus of claim 7, wherein said radiant heating means comprises first and second heating means, and said rotor is secured between said first and second heating means.

11. The apparatus of claim 9, wherein said first and second heating means each includes a passageway through which said die means move along said die axis and between the first die position and the second die position.

12. The apparatus of claim 11, wherein said means for securing the rotor includes means for rotating the rotor about its axis from a first circumferential position "n" to a next circumferential position "n+1", wherein a first blade "N" is twisted when the rotor is in the "n" position, and wherein a different blade "N+1" is twisted when the rotor is in the "n+1" position.

13. The apparatus of claim 12, wherein said rotating means automatically rotates the rotor from position "n" to position "n+1" after blade "N" has been twisted.

14. The apparatus of claim 13, wherein said rotating means is constructed and arranged to rotate the rotor such that circumferentially adjacent blades are sequentially twisted.

15. The apparatus of claim 1, wherein said die means have passages therein, and said apparatus includes means for circulating coolant through said passages.

16. Apparatus for increasing the twist of blades of an integrally bladed rotor from a first degree of twist to a second degree of twist, the rotor comprising a disk having an axis, a rim, and a plurality of circumferentially spaced apart blades extending radially outwardly from the rim and integral therewith, the apparatus comprising:

(a) first and second blade forming die means having surfaces for contacting substantially the entire blade surface, wherein said die surfaces cooperate to form a cavity substantially corresponding to a blade having the second degree of twist, said die means each having coolant carrying passages therein;

(b) means for securing the rotor in a fixed position between said first and second die means;

(c) radiant heating means for providing a heating zone which raises the temperature of the blade to be twisted and the rim from which said blade extends to a hot forming temperature, said heating means comprising first and second heating means in opposing relation to each other such that said securing means is disposed between said first and second heating means; and (d) means for moving said first and second die means into a first die position such that both of said die means are in twisting contact relation with substantially the entire blade surface while the blade is in said heating zone, said moving means also including means for moving both of said die means into a second die position such that said die means are in noncontacting relation with the blade in said heating zone and said die means are outside of said heating zone, and wherein each of said heating means includes passageway means therein and said die means move through said passageway means between the first and second die positions, and wherein said securing means includes means for rotating said rotor about its axis such that circumferentially adjacent blades are sequentially twisted in said die means.

* * * * *